US008733717B2

(12) United States Patent
Devereux

(10) Patent No.: US 8,733,717 B2
(45) Date of Patent: May 27, 2014

(54) HEIGHT ADJUSTMENT APPARATUS

(75) Inventor: Mark Devereux, Derby (GB)

(73) Assignee: Gordon Ellis & Company, Derby (GB)

( * ) Notice: Subject to any disclaimer, the term of this patent is extended or adjusted under 35 U.S.C. 154(b) by 177 days.

(21) Appl. No.: 13/213,268

(22) Filed: Aug. 19, 2011

(65) Prior Publication Data

US 2012/0043435 A1 Feb. 23, 2012

(30) Foreign Application Priority Data

Aug. 20, 2010 (GB) ..... 1013937.6

(51) Int. Cl.
*F16M 11/24* (2006.01)
*A47B 91/00* (2006.01)

(52) U.S. Cl.
CPC ..... *A47B 91/002* (2013.01)
USPC ..... 248/188.8; 248/188.2; 248/188.4; 248/614

(58) Field of Classification Search
USPC ..... 248/188.8, 188.9, 688, 615, 673, 677, 248/614
See application file for complete search history.

(56) References Cited

U.S. PATENT DOCUMENTS

| | | | | |
|---|---|---|---|---|
| 575,806 | A * | 1/1897 | Garvey | 248/188.2 |
| 1,173,990 | A | 2/1916 | Von der Lin et al. | |
| 1,389,572 | A * | 9/1921 | Berg | 248/188.4 |
| 2,072,791 | A * | 3/1937 | Baer | 248/407 |
| 2,457,723 | A * | 12/1948 | Pura | 16/32 |
| 6,068,234 | A * | 5/2000 | Keus | 248/637 |
| 6,626,405 | B1 * | 9/2003 | Keast et al. | 248/188.9 |
| 7,234,199 | B2 * | 6/2007 | Bushey | 16/42 R |
| 7,866,096 | B2 * | 1/2011 | Lee et al. | 52/126.6 |
| 8,256,175 | B2 * | 9/2012 | Buzon | 52/263 |
| 2002/0093237 | A1 * | 7/2002 | Martin | 297/463.1 |

FOREIGN PATENT DOCUMENTS

| | | | |
|---|---|---|---|
| DE | 197 55 854 | C1 | 6/1999 |
| GB | 2309634 | A | 8/1997 |
| GB | 2387322 | A | 10/2003 |
| GB | 2387323 | A | 10/2003 |
| JP | 63-199646 | U | 12/1988 |
| JP | 2009-165792 | A | 7/2009 |

OTHER PUBLICATIONS

Extended European search report issued Jan. 23, 2012 in corresponding European patent application No. 11250704.1.

* cited by examiner

*Primary Examiner* — Amy Sterling
(74) *Attorney, Agent, or Firm* — Pearne & Gordon LLP

(57) ABSTRACT

A height adjustment unit 10 for raising the height of a chair or bed. The unit 10 comprises a ground engaging support member 12 with an internal thread 18. A height adjustment member 14 is engageable with the thread 18 to be rotatable to a required height. A sheet 56 of a resiliently deformable material extends across the top of the member 14 and has a pattern of openings therethrough to receive and grip the leg of a bed or chair.

18 Claims, 4 Drawing Sheets

HEIGHT ADJUSTMENT APPARATUS

This invention concerns height adjustment apparatus, and particularly but not exclusively height adjustment apparatus for furniture and the like.

It is often required to adjust the height of an item of furniture. For instance, the height of seating, beds or other furniture may often desirably be increased for use by the elderly, infirm or disabled.

A number of prior proposals for raising furniture have been made, but these have often proved not wholly satisfactory in being complicated to operate or fit, and/or not providing secure enough support such that there is a danger of the furniture falling over.

According to the present invention there is provided height adjustment apparatus, the apparatus comprising a ground engaging support member with an internal thread, a height adjustment member located within the support member and extending upwardly therefrom, the height adjustment member being threadably engageable with the support member such that relative rotation of the height adjustment member causes raising or lowering thereof relative to the support member, and one or more item engagement arrangements locatable within the height adjustment member and configured so as to engage with an item extending upwardly therefrom, whereby the height of the item can be adjusted.

The or one of the item engagement arrangements may comprise a sheet of a resiliently deformable material, with one or more openings in the sheet such that an item can be pushed through the opening or openings, and the resiliently deformable material will grip the item extending therethrough.

The resiliently deformable material may be PVC.

A plurality of interconnected openings may be provided in the sheet.

The openings may be in the form of interconnecting slots, which slots may have an at least generally radial configuration about an interconnecting central opening.

The or one of the item engaging arrangements may comprise a rigid member which can support an item thereon, and to which the item can be adhered and/or mounted by one or more fastening means.

The or each item engaging arrangement may be selectively mountable within the height adjustment member, and one or more fittings may be provided on the item engaging arrangement to provide mounting within the height adjustment member.

A window may be provided through the support member, through which window a part of the height adjustment member can be viewed, and a height scale may be provided on the height adjustment member such that the amount of additional height provided by the height adjustment apparatus can be read. More than one scale may be provided on the height adjustment member, and scales in different units may be provided.

The support member may be internally threaded for substantially the whole height thereof. A rim around the lower part of the height adjustment member may be engageable with the support member thread.

A ground engageable base member may be mountable on the underside of the support member, and recesses may be provided in the underside of the based member to receive feet appropriate to the flooring upon which the apparatus is to be used.

A connection member may be provided engageable with the support member, and connectable to another such height adjustment apparatus to provide a required spacing therebetween, with the connection member including a collar which slidingly fits over the support member, and a link member extending from the collar.

The link member may extend from at least adjacent one of the lower or upper edge of the collar, and be spaced from the other of the lower or upper edge of the collar, such that if the connection member is turned over relative to the support member, the link member will be at a different height such that link members extending from respective height adjustment apparatus can be connected together one above each other.

Cooperating formations may be provided on the inside of the link member collar and the outside of the support member, to prevent relative rotation therebetween once the formations are engaged. A plurality of formations may be provided around the inside of the collar to permit different respective orientations between the link member and the support member. Spaced projections on the outside of the support member may be engageable with a respective one or ones of a plurality of recesses on the inside of the collar.

Embodiments of the present invention will now be described by way of example only and with reference to the accompanying drawings, in which: —

Figure 1:
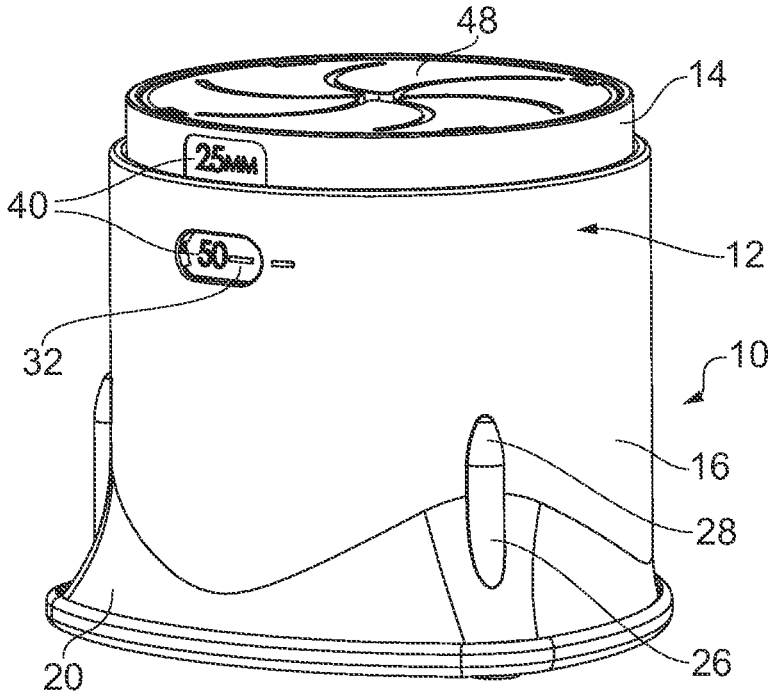
FIG. 1 is a diagrammatic perspective view of a height adjustment apparatus according to the invention.
Figure 2:
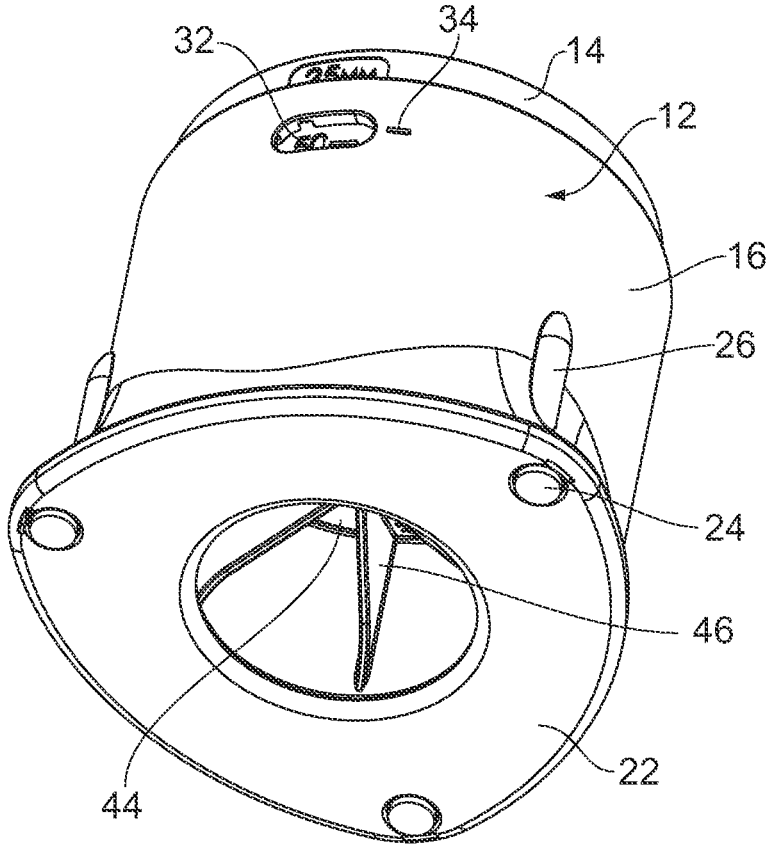
FIG. 2 is a diagrammatic perspective view from beneath of the apparatus of FIG. 1.

FIGS. 1 to 6 show height adjustment apparatus suitable for example for raising the height of a chair or bed for instance for use by the elderly, infirm or handicapped. The apparatus includes a height adjustment unit 10 which includes a ground engaging support member 12 and a height adjustment member 14.

The support member 12 comprises a principally cylindrical body 16 with an internal thread 18 extending for substantially the whole height thereof. A diverging moulding 20 is provided on the base of the body 16 and a base member 22 engages on the moulding 20. Three recesses are provided on the underside of the base member 22 which can receive feet 24 usable for instance on laminate flooring or otherwise. Obviously different feet can be chosen for different types of flooring.

The moulding 20 provides three downwardly extending projections 26 each with a convergent upper end 28

An oval window 32 is provided through the body 16 towards an upper part thereof and has a centre line 34 adjacent thereto. If required a similar such window may be provided on an opposite side of the body 16.

The height adjustment member 14 comprises a smaller cylindrical body 36 with a helical rim 38 towards the base thereof which is threadably engageable in the thread 18. A scale 40 is provided on the outside of the body 14 which as shown is marked in millimeters. The scale 40 can be read through the window 32 to indicate the amount of height adjustment provided by the units 10. A further scale is provided on the opposite side of the body 36, which scale is in different units, namely inches.

A pair of projections 42 are provided extending internally for a short distance on opposite sides of the body 36 spaced from the top of the body 36. The lower end of the body 36 is closed by a base 44 with strengthening ribs 46.

The unit 10 includes two item engaging arrangements 48. Each arrangement 48 comprises a ring 50 of a size to slidingly fit within the body 36. Two diametrically opposite longitudinal grooves 52 are provided in the outside of the ring 50 of a size to receive the projections 42. Two recesses 53 are also provided diametrically opposite each other on the outside of the ring and equally spaced from the grooves 52. The recesses 53 are of a size to slidingly receive the projections 42, and each comprise a longitudinal groove 54 connecting with a short circumferential groove 55.

A sheet 56 of a resiliently deformable material such as PVC extends across the ring 50. A pattern of openings is provided through the sheet 56 in the form of a central opening 58 with six generally radial but curved slots 60 extending therefrom.

The units 10 can be used as follows. The arrangements 48 are fitted into the body 36 as follows. The lowermost arrangement 48 is aligned such that the grooves 52 align with the projections 42, allowing the arrangement 48 to slide therepast. The uppermost arrangement 48 is then aligned such that the entry to each recess 53 aligns with a respective projection 42 and the projection 42 can be slid into the recess 53. The arrangement 48 is then rotated until the projections 42 locate in the closed end of the respective circumferential grooves 55.

The required additional height provided by the unit 10 can then be set by rotation of the body 36 relative to the body 10, with anti clockwise rotation of the body 36 raising the same, and clockwise rotation causing lowering. The height gain can be read on the scale 40 through the window 32, with the respective height indicated adjacent the line 34.

Once the required height has been set, an item such as a bed or chair leg can be pushed through the two arrangements 48, which will deform to receive the leg, and then securely engage same. The provision of the two arrangements 48 prevents relative pivoting between the leg and the arrangements 48. In some instances though it may only be required to use one such arrangement.

Figure 7:
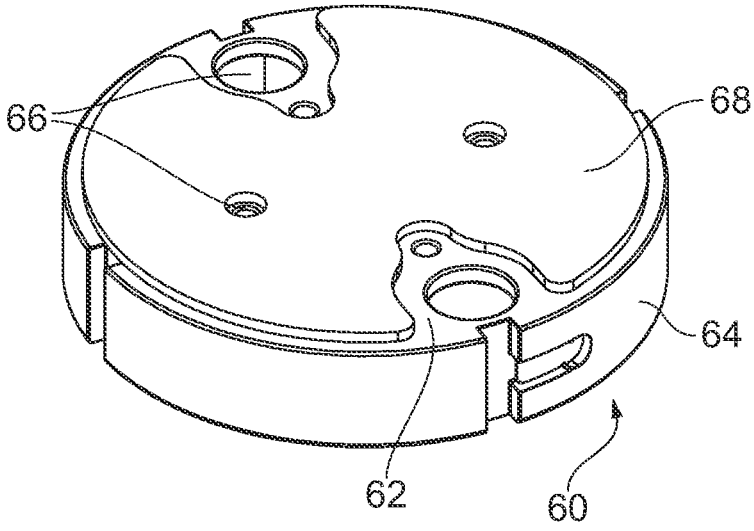
FIG. 7 is a perspective view of an alternative component of the apparatus.

FIG. 7 shows a different apparatus engaging arrangement 60. In this instance a disc 62 extends across a ring 64, and a number of openings 66 are provided through the discs 62. The openings 66 could receive fastening means such as screws to mount the arrangement 60 onto the foot of an item of furniture. Alternatively, or in addition, a sticky pad 68 could be provided on the discs 62 to adhere to the under side of a leg. The ring 64 and disc 62 may be integral with each other, and may be formed as a single component, perhaps by one moulding.

Figure 6:
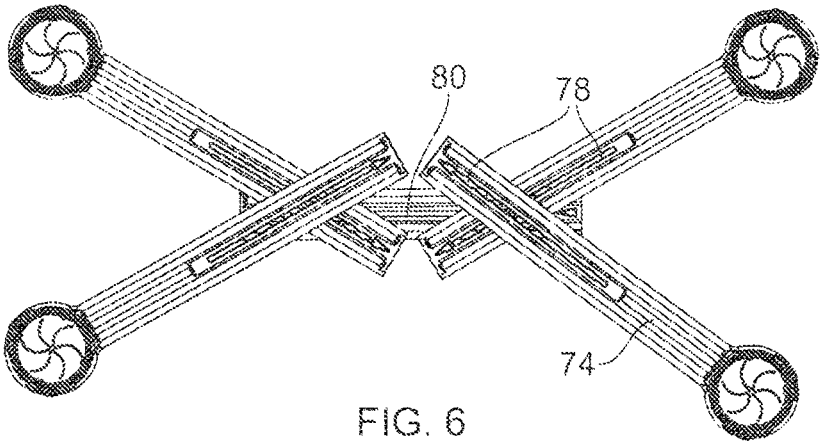
FIG. 6 shows a configuration of four apparatus according to FIG. 1 with associated connection members.
Figure 3:
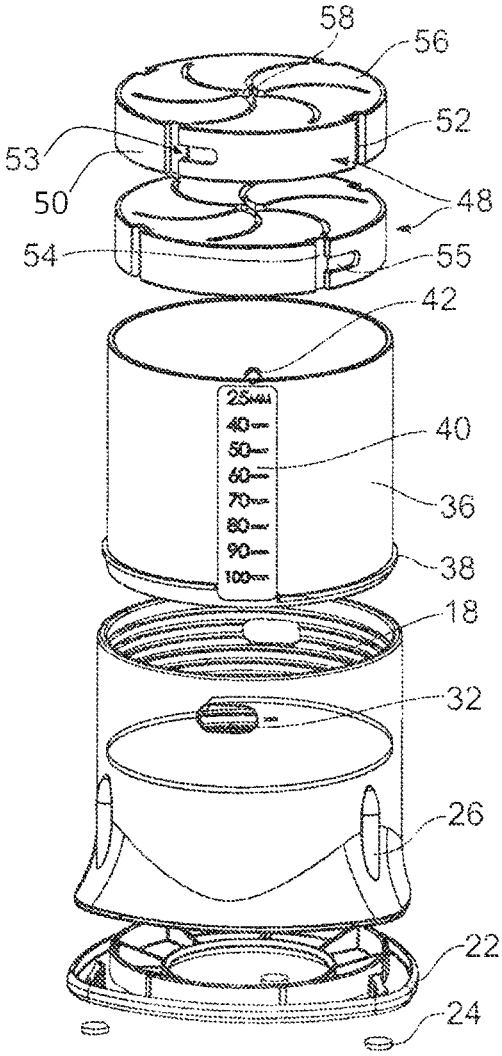
FIG. 3 is a diagrammatic exploded view of the apparatus of FIG. 1.
Figure 4:
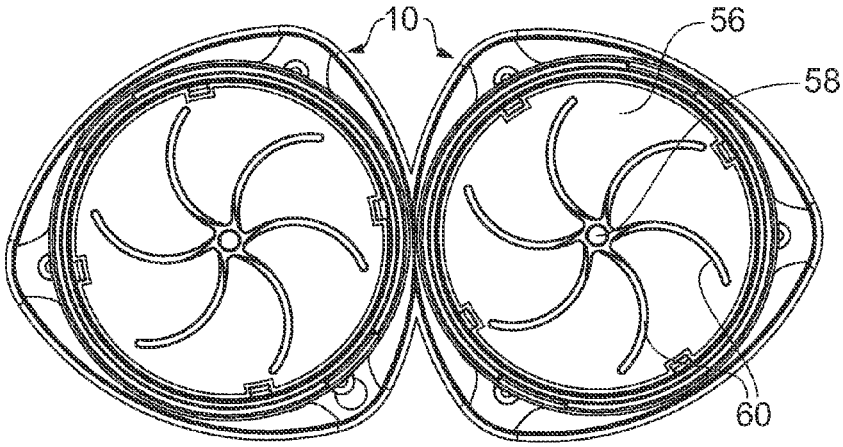
FIG. 4 is a plan view of two apparatus of the type shown in FIG. 1 adjacent each other.
Figure 5:
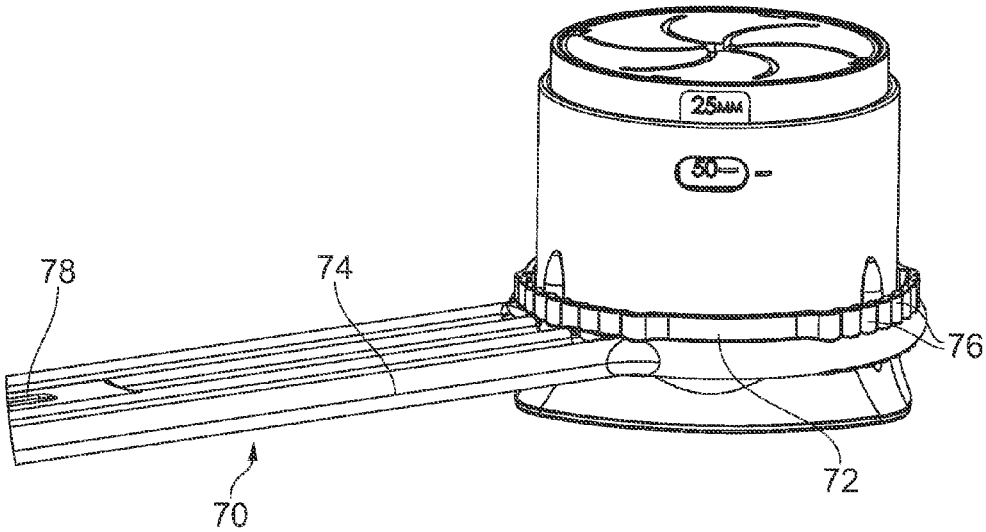
FIG. 5 is a diagrammatic perspective view of the apparatus of FIG. 1 with a connection member mounted thereto.

FIGS. 5 and 6 show use of the unit 10 with other such units and a number of connection members 70 as best illustrated in FIG. 5. Each connection member 70 includes a collar 72 with a link member 74 extending therefrom. The collar 72 is a sliding fit around the outside of the body 16, and a plurality of recesses 76 are provided in the inside of the collar 72 to receive a respective one of the projections 26 to prevent relative rotation between the connection member 70 and the unit 10. In use the connection member 70 can be located on the body 16 spaced a little way above the bottom thereof, and rotated to a required position. The connection member 70 can then be lowered such that the respective recesses 76 engage with the projections 26.

The link members 74 are elongate and include slots 78 to permit fastening means to extend therethrough in a conventional manner. A further link member 80 may be used which does not include a collar, but simply interconnects link members 74 extending from collars 72. The link members 74 extending from the collars 72 extend from adjacent one end of the collar 72, such that if a connection member 70 is turned over, the respective link member will be at a different height, such that adjacent link members can be provided located one above each other as shown in FIG. 6.

There are thus described height adjustment apparatus which provide for a number of advantages. The use of a screw thread provides for ready and essentially infinite adjustment. The engagement arrangements using the resiliently deformable material can readily be used, without requirement for adjustment, yet provide good engagement with furniture legs and other items. The same units can be used with different engaging arrangements as illustrated. For instance with a block foot or other item which cannot be used with the resiliently deformable engaging arrangements, the disc engaging arrangements 60 can be used, potentially with fastening means such as screws, sticky pads or adhesive.

Various other modifications may be made without departing from the scope of the invention. For instance a different number of engaging arrangements may be used. The openings in the resiliently deformable material may take a different form. The connection members may take a different form.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. Height adjustment apparatus, the apparatus comprising a ground engaging support member, the support member being internally threaded within a bore of that member, a height adjustment member located within the support member and extending upwardly therefrom, the height adjustment member being threadably engageable with the support member such that relative rotation of the height adjustment member causes raising or lowering thereof relative to the support member, and one or more item engagement arrangements locatable within the height adjustment member and configured so as to engage with an item extending upwardly therefrom, whereby the height of the item can be adjusted, at least one of the one or more item engagement arrangements comprising a sheet of a resiliently deformable material, a plurality of interconnected openings being provided in the sheet such that an item can be pushed through the openings, and the resiliently deformable material will grip the item extending therethrough, wherein the openings are in the form of interconnecting slots, the interconnecting slots being curved and extending at least generally radially from an interconnecting central opening.

2. Apparatus according to claim 1, wherein the resiliently deformable material is PVC.

3. Apparatus according to claim 1, wherein at least one of said one or more item engagement arrangements comprises a rigid member which can support an item thereon, and to which the item can be adhered and/or mounted by one or more fastening means.

4. Apparatus according to claim 1, wherein at least one of said one or more item engagement arrangements is selectively mountable within the height adjustment member.

5. Apparatus according to claim 4, wherein one or more fittings are provided on the one or more item engagement arrangements to provide mounting within the height adjustment member.

6. Apparatus according to claim 1, wherein a window is provided through the support member, through which window a part of the height adjustment member can be viewed.

7. Apparatus according to claim 6, wherein a height scale is provided on the height adjustment member such that the amount of additional height provided by the height adjustment apparatus can be read.

8. Apparatus according to claim 7, wherein more than one scale is provided on the height adjustment member.

9. Apparatus according to claim 1, wherein the support member is internally threaded for substantially the whole height thereof.

10. Apparatus according to claim 9, wherein a rim around the lower part of the height adjustment member is engageable with the support member thread.

11. Apparatus according to claim 1, wherein a ground engageable base member is mountable on the underside of the support member.

12. Apparatus according to claim 11, wherein recesses are provided in the underside of the base member to receive feet appropriate to the flooring upon which the apparatus is to be used.

13. Height adjustment apparatus, the apparatus comprising a ground engaging support member with an internal thread, a height adjustment member located within the support member and extending upwardly therefrom, the height adjustment member being threadably engageable with the support member such that relative rotation of the height adjustment member causes raising or lowering thereof relative to the support member, and one or more item engagement arrangements locatable within the height adjustment member and configured so as to engage with an item extending upwardly therefrom, wherein a connection member is provided engageable with the support member, and connectable to another such height adjustment apparatus to provide a required spacing therebetween, with the connection member including a collar which slidingly fits over the support member, and a link member extending from the collar.

14. Apparatus according to claim 13, wherein the link member extends from at least adjacent one of the lower or upper edge of the collar, and is spaced from the other of the lower or upper edge of the collar, such that if the connection member is turned over relative to the support member, the link member will be at a different height such that link members extending from respective height adjustment apparatus can be connected together one above each other.

15. Apparatus according to claim 13, wherein cooperating formations are provided on the inside of the link member collar and the outside of the support member, to prevent relative rotation therebetween once the formations are engaged.

16. Apparatus according to claim 15, wherein a plurality of formations are provided around the inside of the collar to permit different respective orientations between the link member and the support member.

17. Apparatus according to claim 16, wherein spaced projections on the outside of the support member are engageable with a respective one or ones of a plurality of recesses on the inside of the collar.

18. Apparatus according to claim 7, wherein a plurality of scales are provided on the height adjustment member, graduated in different units.

* * * * *